United States Patent [19]

Coopersmith

[11] 4,054,310

[45] Oct. 18, 1977

[54] DOOR CHAIN LOCK AND RELEASE SYSTEM

[75] Inventor: Leo Coopersmith, Ivoryton, Conn.

[73] Assignee: Leigh Products, Inc., Coopersville, Mich.

[21] Appl. No.: 620,033

[22] Filed: Oct. 6, 1975

[51] Int. Cl.[2] ..... E05C 17/36

[52] U.S. Cl. ..... 292/264; 292/336.3; 70/93

[58] Field of Search ..... 292/264, 336.3; 70/93

[56] References Cited

U.S. PATENT DOCUMENTS

| | | | |
|---|---|---|---|
| 2,113,104 | 4/1938 | Beaumont | 70/93 |
| 2,724,257 | 11/1955 | Segal | 70/93 |
| 3,004,419 | 10/1961 | Falk | 292/264 |
| 3,657,908 | 4/1972 | Schwartz et al. | 70/93 |

*Primary Examiner*—Robert A. Hafer

*Attorney, Agent, or Firm*—DeLio and Montgomery

[57] ABSTRACT

A door security and release system wherein a door safety chain or similar linkage is tautly held in door securing condition against any efforts to release it from outside the door, with release means associated with the inside door operating member and adapted to be actuated by turning the door operating member.

18 Claims, 15 Drawing Figures

DOOR CHAIN LOCK AND RELEASE SYSTEM

This invention relates to a door security lock and release system wherein a flexible security linkage between the door and jamb is tautly held in door closing condition against any efforts to release it from outside the door.

Various means have been resorted to for making it as difficult as possible for an intruder to release, from outside a door, the releasable end of a door safety linkage such as a chain. Security in that respect is important, so that the chain can perform its primary function, but it is important also—and may be a matter of life or death—for a person on the inside of a chained door to be able, in an emergency, to release the chain and open the door in the least possible time and with the fewest possible number of movements.

In a dark or smoke-filled room the occupant, wishing to open the door, might well be able to find and turn a door knob or other door operating means such as a lever type handle, while being in a state of panic such that finding and releasing an ordinary safety chain would be impossible, and deaths have been attributed to these factors. Facility for opening a chained or similarly secured door in one familiar movement of the door operating member can be a convenience also to sightless persons. The expression "door knob" herein is intended to include door operating members in the nature of handles of any shape, adapted to be manually grasped and turned.

Accordingly, the present invention provides new and improved door security means which reliably prevents unauthorized entry including unauthorized key entry, but which is released simultaneously with turning of a door operating member.

Briefly stated, the invention in one form thereof comprises a flexible security linkage having one end fixed to the door jamb and the free end releasably attached to the door. The free end of the linkage is attached to the door by means of a locking mechanism including a pin, and means are provided, responsive to turning of the door knob, to move the pin and release the other end of the linkage.

It is accordingly an object of the present invention to provide a lock and release system associated with the inside door knob and adapted for actuation simultaneously with the turning of the knob.

It is a further object of the invention to provide a release system in which the grasping and turning of the inside door knob in any normal manner effects actuation of the chain release.

It is another object of the invention to provide a release system which can readily be installed on any door without structural modification thereof.

It is a still further object of the invention to provide releasable holding means for the chain or other linkage which locks with increased force in response to efforts to open the chained door.

The features of the invention which are believed to be novel are particularly pointed out and distinctly claimed in the concluding portion of this specification. However, the invention both as to its organization and operation, together with further objects and advantages thereof, may best be appreciated by reference to the following detailed description taken in conjunction with the drawings, wherein:

FIG. 1 represents an elevation of the flexible linkage, shown and referred to hereinafter as a chain, the release system, and the knob, installed on a door and the adjacent jamb;

FIG. 1*a* represents a detail elevation showing a modified connection between parts of the release system, parts being broken away;

FIG. 1*b* represents a detail elevation from the right of FIG. 1*a*, parts being broken away;

FIG. 2 represents a vertical section on the line 2—2 of FIG. 1, on a larger scale;

FIG. 2*a* represents a detail vertical section on the line 2*a*—2*a* of FIG. 2;

FIG. 2*b* represents a detail elevation, parts being in section and parts broken away, looking in the direction of the arrow 2*b* in FIG. 2;

FIG. 3 represents a top plan view of the elements shown in FIG. 1, the door and jamb being in section;

FIG. 3*a* represents a plan view of an alternate form of latch plate;

Figure 1:
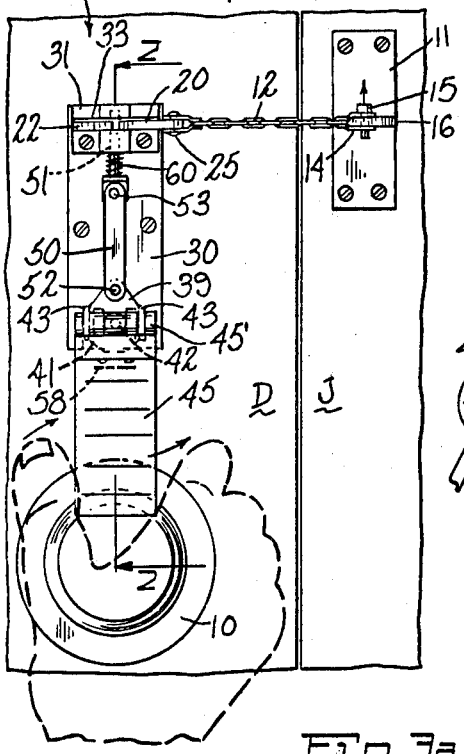

Referring to the drawings, and particularly FIGS. 1 to 6, a door D is adapted to close in a position adjacent the frame or jamb J and is provided with an inside door knob 10 which operates a latch (not shown) in a normal manner. As used herein, the term jamb refers to any fixed portion of the structure adjacent the unhinged edge of the door.

A door security system includes the chain, a base plate 11 to anchor a flexible linkage such as chain 12, and a plate lock and release system 13. Plate 11 is adapted to be mounted securely on the door jamb, as by means of screws, and one end of the chain is attached to the plate either permanently or by means of a clevis 14 and pin 15 engaging boss 16 on the plate. The free end of the chain is provided with a latch plate 20 which includes a hook portion 21 having a tapering nose 22, a body portion 23 and a laterally projecting heel 24. The chain is securely attached to the body portion as by the rivet 25 at a point spaced laterally from the heel. Reference herein to a "chain" is exemplary only, since the linkage may be in the form of a cable, hinged links or other equivalent devices.

The lock and release system comprises a mounting plate 30 having a post 31 adjacent its upper end and another post 32 adjacent its lower end, the upper post being provided with a horizontal slot 33 and a vertical bore 34. An enlarged recess 35 in the base of the slot 33 accommodates a compression spring 36 and a spring cup 37 which is urged resiliently outward, toward the bore 34.

The lower post 32 is vertically elongated with a bearing stub 38 projecting from its lower portion, a lever 39 being pivotally mounted on said stub and retained there by the washer 40 and nut 41 on the end of a bolt 42 passing through the post. The lever 39 is provided with upstanding ears 43 constituting a yoke traversed by a pin 44 on which the rectangular trigger plate 45 is supported for pivotal movement. The sides of the trigger plate extend laterally beyond the ears 43 and straddle them, portions of the trigger plate between the lateral loops 45′ and the central loop 45″ thus being located in the arcuate gaps 46 in the periphery of each ear, whereby pivotal movement of the trigger plate is restricted, e. g., to angles of 20° to 55° with the face of the door.

Figure 2:
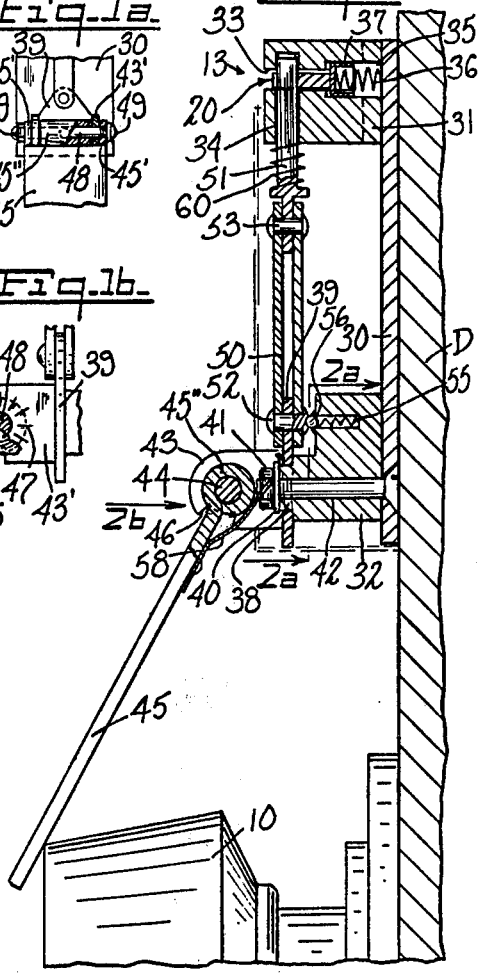

The lever 39 is the actuating element in a toggle assembly including the link 50 and the locking pin 51, the link being pivotally connected to the lever by a rivet 52 and to the locking pin by a rivet 53. The locking pin fits freely in the bore 34 of the upper post and extends, in its upper position, entirely across the slot 33, the slotted post serving as a guide, as shown in FIG. 2. The upper portion of the post 32 is drilled at 55 to receive a ball and spring detent 56, in a position to engage the dished inner end of the rivet 52 when the pin is in its upper position; a spring 60 biases the pin toward its lower position.

The lock and release system is mounted on the door in a position such that the trigger plate 45 can rest on or adjacent to the upper peripheral edge of the inside door operating member such as a door knob 10, as shown in FIGS. 1 and 2. A corresponding placement can readily be arranged with door knobs of any geometrical form, including the lever type handle shown in FIG. 8, the basic requirement being that the trigger plate must lie in the path of movement of a hand or fingers when the knob is grasped and turned in any normal manner. In the form shown in FIGS. 1 and 2, the trigger plate is biased toward the knob by a leaf spring 58 riveted to the back of the trigger plate and having fingers 59 passing each side of the bolt 42 and nut 41 to bear against the surface of the lever 39. The trigger plate may suitably have a width of about 1½ inches, to fit between the thumb and forefinger of a hand grasping the knob, as indicated in FIG. 1.

Figure 1A:
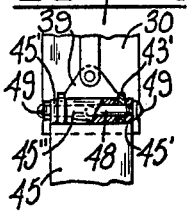
Figure 1B:
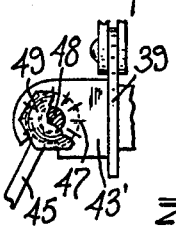

According to the modification shown in FIGS. 1*a* and 1*b*, the spring 58 of FIGS. 1 and 2 is omitted and the trigger plate may be held in an adjusted fixed position relative to the lever 39, this result being achieved by providing radial ridges 47 on the side surfaces of the ears 43′, the pin 44 being replaced by a threaded rod 48. Cap screws 49 on the ends of the rod 48 can be tightened to draw the inner edges of the loops 45′ into engagement with the ridges 47, to hold the trigger plate at any desired angle (e.g., resting against the door knob or adjacent thereto) within the limits determined by the gaps 46.

Figure 6:
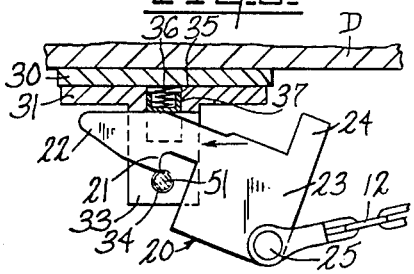
FIG. 6 represents a detail top plan view, partly in section, showing the position of the chain latch plate when it is inserted in the lock system.

In operation, a person within the house or room to be secured introduces the latch plate 20 into the slot 33 as shown in FIG. 6, depressing the spring 36; when the hook 21 has passed the locking pin 51 the spring 36 and cup 37 ensure engagement of the latch plate with the pin, in the position of FIGS. 1, 2, 3 and 5. In this position any additional tension on the chain, as by an effort at forcible entry, will cause the hook 21 to engage more tightly the locking pin, due to the lever arm created by the heel 24 bearing against the mounting plate 30 as the opposite rear corner of the latch plate is pulled by the chain. The heel 24 and chain connection 25 should lie on opposite sides of the line from the chain base to the locking pin.

Figure 3A:
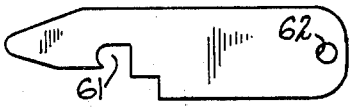
Figure 3:
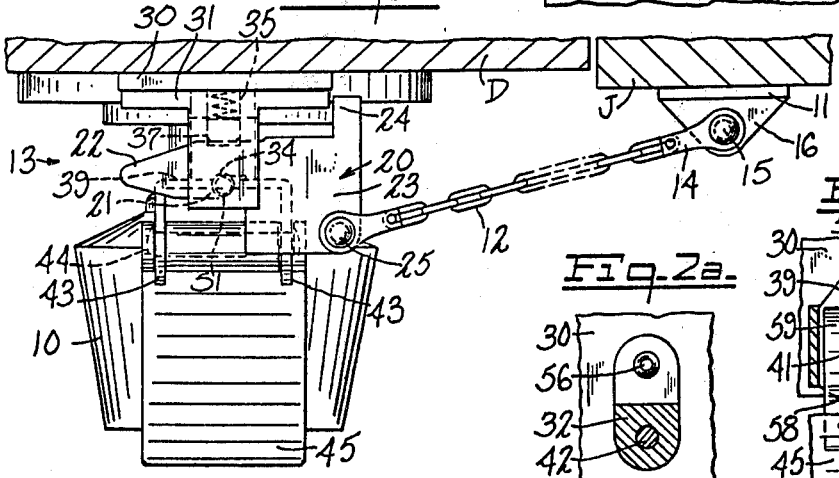
Figure 2A:
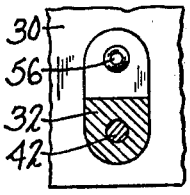
Figure 2B:
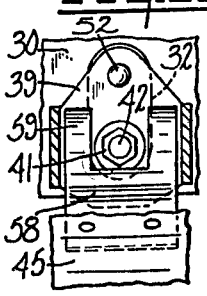

In the alternate form of latch plate, shown in FIG. 3*a*, the locking pin will be engaged by the hook 61, the chain being attached at 62 and the door opening tensional force being in a substantially straight line. In this connection it must be noted that the chain, in locked position with either form of latch plate, may have little or no slack so that even minimal door opening is resisted, contrasting with a normal chain which requires slack to permit engagement of its free end in a bayonet-type slot.

Figure 4:
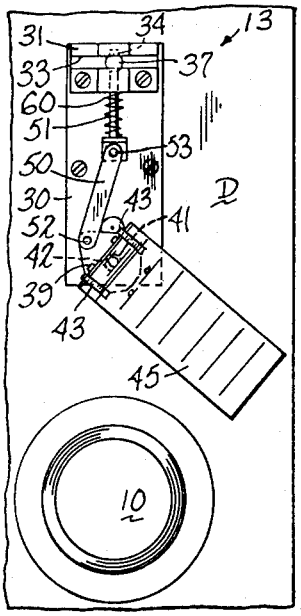
FIG. 4 represents an elevation of the chain holding elements, and door knob, in released position.
Figure 5:
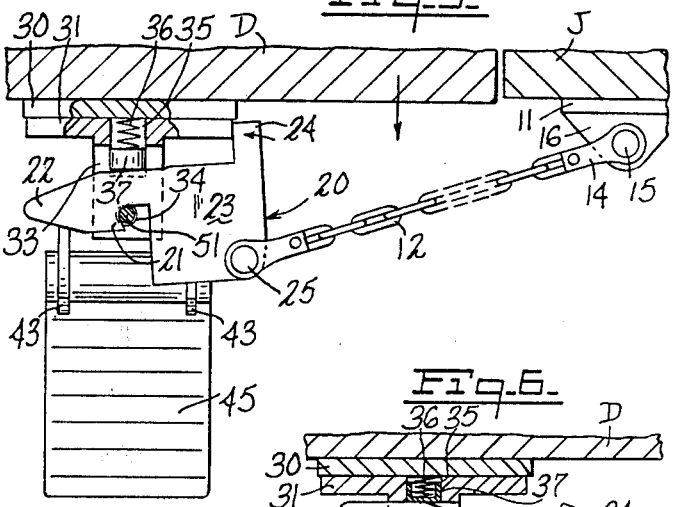
FIG. 5 represents a top plan view, similar to FIG. 3, with parts broken away and the door knob omitted.

With the parts in the position shown in FIGS. 1, 2, 3 and 5, a person wishing to open the door need merely grasp the knob in a normal manner and turn it slightly (5° or more) in either direction (the total possible movement may be about 50° in either direction). A hand on the knob (broken lines in FIG. 1), turning it in any non-contorted manner, will swing the trigger plate far enough to free the rivet 52 from the detent 56 and permit the spring 60 to withdraw the locking pin, as shown in FIG. 4. This immediately frees the chain latch plate which drops away from the lock and release system so that the door can be opened.

Figure 7:
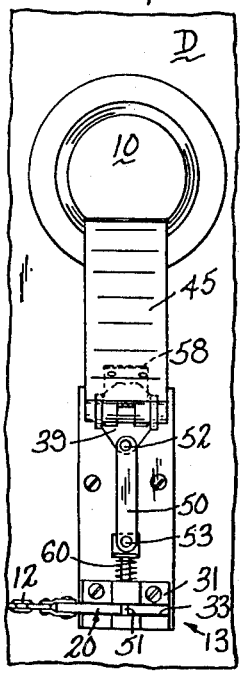
FIG. 7 represents an elevation, similar to FIG. 1, showing the release system and knob installed on a door with the release system below the knob.
Figure 8:
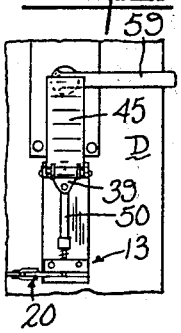
FIG. 8 represents a detail elevation, similar to the upper portion of FIG. 7, showing the applicability of the release system to a lever-type knob.

It will usually be convenient to install the chain lock and release system above the door knob, as in FIGS. 1–5, but it would function in the same manner if placed below the knob, as shown in FIGS. 7 and 8. FIG. 8 shows also the applicability of the system to a lever type handle 59, the trigger and other elements being the same as in FIG. 7. In either position the same elements are adapted for right hand or left hand installation. The attachment of the chain to its base by means of the clevis 14 and pin 15 is an additional safety feature, permitting detachment of the chain at that end if necessary, but permanent attachment is generally preferred.

Figure 9:
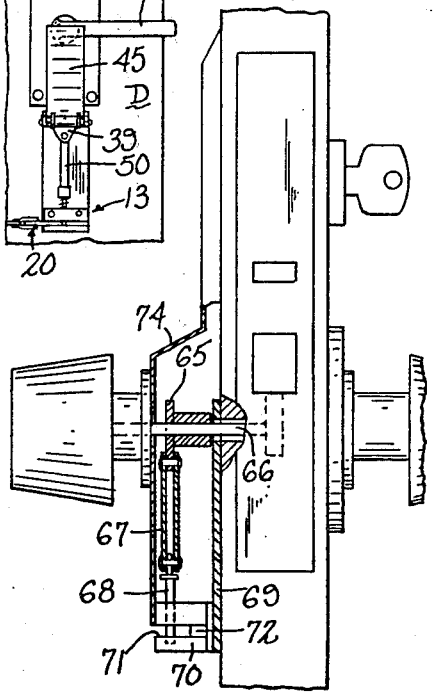
FIG. 9 represents an elevation, partly in vertical section, of a modified form of the lock and release system, adapted for actuation by means in the inside door knob.
Figure 10:
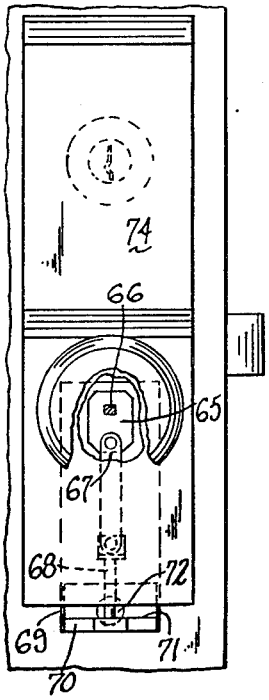
FIG. 10 represents an elevation of the mechanism shown in FIG. 9, parts being broken away.

The system disclosed herein is intended primarily as a fail-safe arrangement for opening a chained door from the inside—in an emergency or otherwise—the parts described above being designed for addition to any existing door. Certain elements of the system could, alternatively, be built into a lock mechanism, as shown in FIGS. 9 and 10 where a lever 65 is mounted on the knob shaft 66 and connected by link 67 to the locking pin 68. A base plate 69, fixed to the door, carries a post 70 having a horizontal slot 71, traversed vertically by the pin 68 and adapted to receive the latch plate of a chain (not shown) exactly as described above. Turning of the knob and its shaft 66 in either direction will lift the pin and release the chain latch plate, which is held in engagement with the pin 68 by a spring and cup assembly 72, corresponding to the parts 36, 37 described above. This arrangement requires only minor modification of the normal lock mechanism, as by providing a longer shaft 66 and enlarging the face plate 74 to make room for the added elements.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. A door lock and release system to be used on a door having a door operating member requiring rotation to open the door, comprising a linkage having one end connectable to the door jamb, and a lock and release mechanism adapted to be mounted on the door adjacent the knob, said mechanism including a locking pin adapted to be engaged with the free end of the linkage, means for holding the pin releasably in engagement with said free end of the linkage and means adapted for juxtaposition with the door operating member for actuating said holding means to release the linkage from the pin when said juxtaposed means is moved by the manual rotation of the door operating member.

2. A system according to claim 1 wherein the free end of the linkage is provided with a latch plate having a portion adapted for engagement with the pin.

3. A system according to claim 2 wherein said portion is a hook.

4. A system according to claim 3 wherein the latch plate is so proportioned that, in engaged position, a line from the fixed end of the linkage to its free end lies farther from the door than the line from the fixed end to the pin.

5. A system according to claim 1 wherein the lock and release mechanism includes a base plate spaced from the operating member and a locking pin guide on said base plate, the holding means comprising a lever pivotally mounted on said base plate and toggle linkage connecting said lever to the pin.

6. A system according to claim 5 which includes resilient means associated with the locking pin guide, engageable with the free end of the linkage and biased to eject said free end upon disengagement thereof from the locking pin.

7. A system according to claim 5 wherein the means for actuating the holding means comprises a trigger extending from the lever to the door operating member in a position to be moved when said member is turned.

8. A system according to claim 5 which includes pin stop means mounted on the base plate, said pin stop means comprising resilient means for holding the locking pin in its locking position.

9. A system according to claim 7 wherein the trigger is pivotally connected at one end to the lever and extends to a position contacting the door operating member.

10. A system according to claim 9 which includes means limiting the pivotal movement of the trigger.

11. A system according to claim 9 which includes means for adjustably fixing the angular position of the trigger.

12. A system according to claim 4 wherein the door operating member and lever are mounted on a common shaft.

13. The system of claim 1 wherein said means adapted for juxtaposition with the door operating member is connected to the shaft of said member.

14. The system of claim 1 wherein said means adapted for juxtaposition with the door operating member is a member pivotally mounted to said mechanism and positioned to be engaged and pivoted by a hand turning the door operating member.

15. A door chain lock and release system adapted for mounting on a door associated with a door jamb and provided with a door operating member, the system comprising a door safety chain having one end fixed to the door jamb and a lock and release mechanism mounted on the door adjacent the operating member, said mechanism including a base plate, a locking pin guide on said base plate, a slot in said guide adapted to receive the free end of the chain, a locking pin movable in said guide to and from a position extending across said slot in engagement with the free end of the chain, resilient means associated with said guide and engageable with the free end of the chain to eject said free end from the slot upon disengagement of the pin from said free end, a trigger pivotally mounted relative to the base plate, and actuating means connecting the trigger to the locking pin, the trigger being adapted to rest closely adjacent the door operating member and to actuate the locking pin when moved by a hand rotating the door operating member in either direction.

16. A door security system for use on a door having a rotatable operating member and mounted adjacent a door jamb, comprising a flexible linkage having one end connected to the jamb, a latch and release mechanism mounted to the door adjacent the operating member, said mechanism including means for securing the other end of said linkage to said mechanism and means extending from said mechanism and adapted for juxtaposition with the operating member for actuating said securing means to release the linkage from the securing means when said juxtaposed means is moved by manual rotation of the operating member.

17. The system of claim 16 wherein said holding means comprises a pin arranged to be latched to said other end of said linkage, said pin connected to said juxtaposed means.

18. The system of claim 16 wherein said juxtaposed means is pivotally mounted to said mechanism, and a link pivotally mounted to said juxtaposed means and said pin, whereby pivotal motion of said juxtaposed means causes said link to retract said pin.

* * * * *